US006661413B2

(12) United States Patent
Sakaguchi

(10) Patent No.: US 6,661,413 B2
(45) Date of Patent: Dec. 9, 2003

(54) WIRING STRUCTURE AND METHOD THEREOF FOR A LCD MODULE

(75) Inventor: Yoshitami Sakaguchi, Fujisawa (JP)

(73) Assignee: International Business Machines Corporation, Armonk, NY (US)

( * ) Notice: Subject to any disclaimer, the term of this patent is extended or adjusted under 35 U.S.C. 154(b) by 238 days.

(21) Appl. No.: 09/681,375

(22) Filed: Mar. 27, 2001

(65) Prior Publication Data

US 2001/0033259 A1 Oct. 25, 2001

(30) Foreign Application Priority Data

Mar. 27, 2000 (JP) ..... 2000-086670

(51) Int. Cl.[7] ..... G09G 3/18
(52) U.S. Cl. ..... 345/211; 345/204; 345/100
(58) Field of Search ..... 345/87–104, 204–206, 345/211–213; 349/143, 148

(56) References Cited

U.S. PATENT DOCUMENTS 5,621,439 A * 4/1997 Okada et al. ..... 345/211
5,831,387 A * 11/1998 Kaneko et al. ..... 313/495
5,999,242 A * 12/1999 Walton et al. ..... 349/148
6,429,841 B1 * 8/2002 Lee ..... 345/89

FOREIGN PATENT DOCUMENTS

JP 2-67521 A * 3/1990

* cited by examiner

*Primary Examiner*—Lun-Yi Lao
(74) *Attorney, Agent, or Firm*—Derek S. Jennings

(57) ABSTRACT

An LCD module includes liquid crystal cells forming a image display area on a substrate, a plurality of driver LSIs mounted on the substrate for applying voltages to the liquid crystal cells, and a wiring structure formed on the substrate for supplying a voltage to the plurality of driver LSIs. The wiring structure supplies the voltage to the plurality of driver LSIs, with the wiring resistance gradually changing from a voltage supply point.

13 Claims, 13 Drawing Sheets

(a) Reference voltage generation by wiring of conventional system (7LSI cascade connection)

(b) Reference voltage generation by wiring of the present system (7LSI cascade connection)

| Wiring segment | Conventional system | Present system |
|---|---|---|
| Voltage supply point – LSI 1 (forward wiring) | 187/13. 7 | 187/13. 7 |
| LSI 1 – LSI 2 (forward wiring) | 187/13. 7 | 160/16. 0 |
| LSI 2 – LSI 3 (forward wiring) | 187/13. 7 | 133/19. 2 |
| LSI 3 – LSI 4 (forward wiring) | 187/13. 7 | 107/24. 0 |
| LSI 4 – LSI 5 (forward wiring) | 187/13. 7 | 80/32. 0 |
| LSI 5 – LSI 6 (forward wiring) | 187/13. 7 | 53/48. 0 |
| LSI 6 – LSI 7 (forward wiring) | 187/13. 7 | 27/96. 0 |
| LSI 7 Halfway point | N/A | –/5. 0 |
| LSI 7 – LSI 6 (Backward wiring) | N/A | 160/16. 0 |
| LSI 6 – LSI 5 (Backward wiring) | N/A | 133/19. 2 |
| LSI 5 – LSI 4 (Backward wiring) | N/A | 107/24. 0 |
| LSI 4 – LSI 3 (Backward wiring) | N/A | 80/32. 0 |
| LSI 3 – LSI 2 (Backward wiring) | N/A | 53/48. 0 |
| LSI 2 – LSI 1 (Backward wiring) | N/A | 27/96. 0 |

(a) Wiring widths and resistances used in simulation [μm] / [Ω]

| Generated voltage | Conventional system | Present system (when process changes) | Ladder resistor system |
|---|---|---|---|
| MAX (Duty:100%) | 184. 4 | 20. 5 (25. 1) | 186. 0 |
| MID (Duty:50%) | 100. 9 | 10. 4 (13. 1) | 14. 6 |

(b) Voltage differences between chips in each system [mV]

Fig. 13

WIRING STRUCTURE AND METHOD THEREOF FOR A LCD MODULE

FIELD OF THE INVENTION

The present invention relates to a wiring structure in like a liquid crystal display (LCD), and more particularly to a structure, apparatus and method for supplying an averaged voltage to a plurality of LSIs that are connected in a chain-like manner (i.e., one after another).

BACKGROUND OF THE INVENTION

In recent years, a liquid crystal panel (LCD panel) on which an image is displayed is required to be low in cost. As one means to keep the cost down, Chip On Glass (COG) is commonly known. COG is the technique to mount a couple of or dozens of LCD driver LSI chips, which are provided for one LCD panel, intact on a glass substrate. Also suggested is the combination of COG being combined with Wiring On Array (WOA) that implements the wiring on the glass. According to the COG&WOA technique, it becomes possible to attach the LSI itself directly to the glass substrate, and at the same time, omit the wiring that is presently put on the printed circuit board, so that the cost of production can be vastly lowered and can be granted the requests for a narrow frame in recent years.

On the other hand, there have been some proposals as to the method for achieving the wiring of LCD driver LSIs on glass substrates. For example, one of them is to reduce the number of input signals of LCD driver LSIs to reduce a necessary wiring area, in order to achieve the wiring in frame portions of glass substrates. In addition, the present applicant previously proposed a technique that achieves a fast serial video transfer peculiar to LCD driver LSIs by means of cascade connections (Japanese Patent Application No. Hei 11-351784). Furthermore, there has been proposed a technique to reduce the number of wiring for reference voltage, which must be provided on glass substrates, by generating a reference voltage for y compensation in LCD driver LSIs.

By using the WOA technique, external PCB or Flexible Printed Circuit (FPC) that have been used for the wiring of LCD driver LSIs are no longer needed, whereby drastic cost reduction can be achieved. Also, since mechanical connections are reduced drastically, good results are expected about yield rate.

However, in conventional liquid crystal panels, generally a wiring on glass substrates consists of a very thin metal (2500 Å) and results in high resistance wiring whose sheet resistance is about 0.16Ω/μm. With this high resistance wiring, it is impossible to supply uniform voltage to a plurality of LCD driver LSIs, whereby tens to hundreds mV of voltage difference occurs on the voltages which individual LCD driver LSIs receive, due to the voltage drop in the wiring paths. In case of supplying the reference voltage for y compensation, this voltage difference appears as a gradation difference of every LCD driver LSI, whereby uniformity of outputs can not be maintained due to this gradation difference, which results in significant deterioration in image quality. In light of that, in conventional liquid crystal panels, the wiring to supply the reference voltage for γ compensation can not be provided on the glass substrate, so there has been little choice but to configure in a manner where the wiring with sufficiently low resistance is provided on the external PCB (Printed Circuit Board) or FPC, in order to supply the reference voltage to each LCD driver LSI On the other hand, a method for supplying the uniform voltage is conceivable by making the thickness of metal wiring sufficiently thick or making wiring widths sufficiently wide on the glass substrate, in order to ensure low resistance. However, making the thickness sufficiently thick can cause an increase of process occupied time or other adverse effects on the yield rate of TFT arrays for the production of LCD panels. In case of making wiring widths sufficiently wide, it is necessary to make frame portions of TFT arrays larger in order to secure a wiring space, which greatly runs counter to the requests in recent years. Namely, thought it is possible to provide wiring with low resistance with changing thickness or materials of wiring, which can not sufficiently lead to cost savings and a narrow frame, resulting in no use in employing WOA technique.

Furthermore, in order to generate a reference voltage for γ compensation, a technique is commonly used where an input voltage is divided by ladder resistors provided in the LCD driver LSIs to generate an intended voltage. In this technique, when the wiring of the reference voltage for γ compensation is done by low resistance wiring, a practically unquestionable performance can be achieved, however, with the conventional wiring on the glass, which has high resistance, it is impossible to deliver its thorough performance.

In light of these above technical problems, it is an object of the present invention to reduce the difference of voltages that each LSI receives, in the individual LSIs connected in a chain-like manner (i.e., one after another).

SUMMARY OF INVENTION

The present invention is directed to an apparatus for supplying a voltage for γ compensation to a plurality of driver LSIs mounted on the same substrate as the one on which liquid crystal cells are formed, by using a wiring structure of high resistivity formed on the same substrate. Namely, an LCD module according to the present invention consists of liquid crystal cells forming an image display area on a substrate; a plurality of driver LSIs mounted on this substrate for applying voltages to the liquid crystal cells; and a wiring structure formed on this substrate for supplying a voltage to the plurality of driver LSIs, wherein this wiring structure supplies the voltage to the plurality of driver LSIs, with the wiring whose resistance gradually changing from a voltage supply point. Also, it is characterized in that this wiring structure supplies the voltage to the plurality of driver LSIs via a forward wiring and a backward wiring. Furthermore, it is characterized in that the forward wiring and the backward wiring are connected like a single stroke of the brush to supply the voltage to the plurality of driver LSIs. Note, considering the present invention as a computer, such as a notebook-sized personal computer, the present invention further includes a host for executing an application, and a plurality of driver LSIs mounted on the substrate for applying voltages to the liquid crystal cells based on a signal from the host.

In another aspect of the present invention, a liquid crystal display according to the invention consists of liquid crystal cells forming a image display area on a substrate; a plurality of driver LSIs mounted on this substrate for applying voltages to the liquid crystal cells; and a wiring structure formed on this substrate for supplying a voltage supplied from a voltage supply point to the plurality of driver LSIs; wherein this wiring structure consists of a forward wiring that starts wiring of the driver LSIs from a driver LSI located near the voltage supply point up to a downstream driver LSI in order, thereby supplying the voltage to the driver LSIs; and a backward wiring that starts wiring of the driver LSIs from the downstream driver LSI up to the driver LSI located near the voltage supply point in order, thereby supplying the voltage to the driver LSIs; wherein the directions of voltage drop in the forward wiring and the backward wiring are opposite.

The wiring structure is characterized in that, in the forward wiring, a wiring width is gradually reduced from the wiring for the driver LSI located near the voltage supply point to the wiring for the downstream driver LSI, whereas in the backward wiring, a wiring width is gradually reduced from the wiring for the downstream driver LSI to the wiring for the driver LSI located near the voltage supply point, thereby enabling to gradually change the wiring resistance by means of wiring widths, so that the slope of voltage drop is controlled with a simple wiring structure on the substrate.

It is also characterized in that, the plurality of driver LSIs includes input pads and output pads for connection corresponding respectively to the forward wiring and backward wiring of the wiring structure, wherein the input pads and the output pads are connected by the wiring inside the plurality of driver LSIs, whereby the plurality of driver LSIs are connected in cascade connection by this wiring structure, wherein WOA is implemented with increasing the efficiency of the wiring of the substrate. In addition, it is characterized in that the plurality of driver LSIs are bus-connected to the forward wiring and the backward wiring of this wiring structure, whereby a reference voltage for γ compensation is supplied not through the metal wiring inside the driver LSIs.

In a further aspect of the invention, the present invention is directed to a wiring structure which supplies a voltage to a plurality of LSIs arranged at a specified interval apart, comprising: a voltage supply point receiving a voltage; and a wiring section that starts wiring of the LSIs from a LSI located near the voltage supply point up to a downstream LSI in order, thereby supplying the voltage to the plurality of LSIs; wherein the wiring width is gradually reduced toward the downstream side. Furthermore, this wiring section includes a forward wiring that is provided from the voltage supply point toward the downstream LSI; and a backward wiring that is provided from the downstream LSI toward the LSI located near the voltage supply point, wherein the backward wiring supplies the voltage to the plurality of LSIs with the wiring width being gradually reduced from the downstream LSI toward the LSI located near the voltage supply point.

In a further aspect of the invention, the present invention is directed to a wiring structure which supplies a voltage to a plurality of LSIs arranged at a specified interval apart, comprising: a forward wiring and a backward wiring on a substrate on which a plurality of LSIs are arranged, wherein a wiring resistance of the wirings gradually changes; wherein the voltage is supplied to the plurality of LSIs from both the forward wiring and the backward wiring.

Further, it is characterized in that the forward wiring and the backward wiring are detached from each other, and the forward wiring and the backward wiring are supplied a voltage from different voltage supply points, whereby the voltage is supplied to the plurality of LSIs with keeping an offset voltage small.

Moreover, it is characterized in that the forward wiring and the backward wiring are concatenated, and the forward wiring and the backward wiring are supplied a voltage from the same voltage supply point, whereby the voltage supply point is unified at one place, resulting in simplification of the wiring structure.

In a further aspect of the invention, the present invention is directed to a method for supplying a voltage to a plurality of LSIs mounted on a substrate, the method comprising the steps of: wiring the plurality of LSIs on the substrate using a forward wiring and a backward wiring whose wiring resistance gradually changes; the plurality of LSIs receiving a voltage from both the forward wiring and the backward wiring; and the plurality of LSIs time-averaging the received voltage to generate a reference voltage.

More specifically, a wiring resistance used for the forward wiring and the backward wiring gradually changes, wherein the wiring resistance between adjacent LSIs gradually changes with the ratio of approximately 1/(N−1), 1/(N−2), 1/(N−3), . . . , 1/1 in order (where N is the number of connected LSIs). According to this configuration, it is possible to adjust the slope of voltage drop to be almost linear, whereby the slopes of voltage drop in the forward and backward wirings are in an opposite direction each other, so that the time-average of voltage is kept constant among each LSI.

In a further aspect of the invention, the present invention is directed to a method for supplying a voltage to a plurality of driver LSIs mounted on a substrate, the method comprising the steps of: providing a wiring of high resistivity which gradually changes the wiring width on this substrate; connecting the plurality of driver LSIs to the wiring of high resistivity in order; supplying a voltage to the wiring of high resistivity; supplying a voltage to the driver LSIs via the wiring of high resistivity, wherein a voltage drop occurs between the individual driver LSIs; and generating a reference voltage for γ compensation in the driver LSIs based on the supplied voltage, thereby making use of the voltage drop positively to output a nearly uniform value for γ compensation. It is characterized in that, the provided wiring of high resistivity consists of a forward wiring which supplies a voltage to the driver LSIs from a voltage supply point in order which supplies a voltage to this wiring, and a backward wiring which supplies a voltage to the driver LSIs toward the voltage supply point in order, wherein the forward wiring and the backward wiring are connected.

Various other objects, features, and attendant advantages of the present invention will become more fully appreciated as the same becomes better understood when considered in conjunction with the accompanying drawings, in which like reference characters designate the same or similar parts throughout the several views.

BRIEF DESCRIPTION OF DRAWINGS

FIG. 12 (*b*) depicts the effects on the reference voltage generators using the wiring of the present invention.

FIGS. 13 (*a*) and (*b*) show values used in the simulation of FIGS. 12(*a*) and (*b*).

DETAILED DESCRIPTION

Now the present invention will be described in detail based on the preferred embodiments shown in attached drawings.

Figure 1:
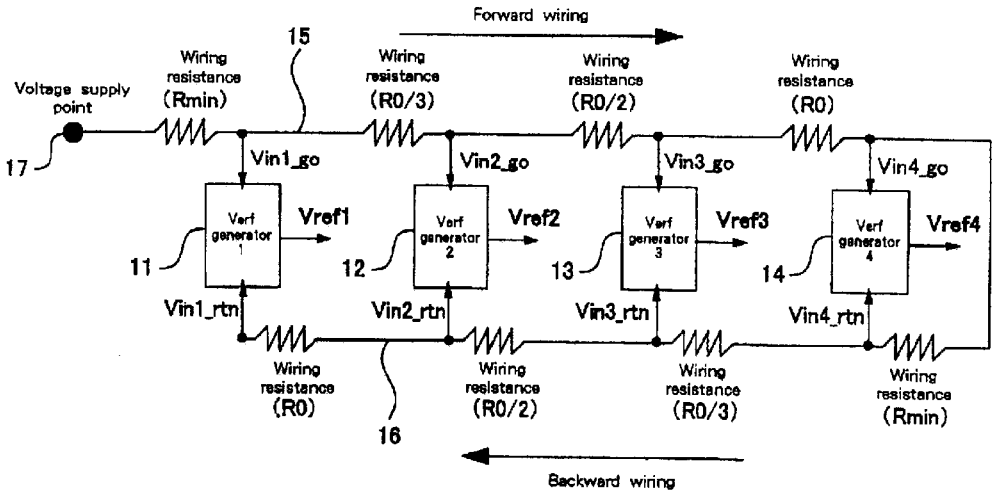
FIG. 1 depicts a diagram illustrating a fundamental configuration of an embodiment of the present invention.

FIG. 1 depicts a drawing illustrating a fundamental configuration of an embodiment of the present invention. Here four liquid crystal display driver LSIs are connected in chain-like manner (i.e., one after another) and reference voltage generator (Vref generator) 11 to 14 built in each liquid crystal display driver are connected to a forward wiring 15 and backward wiring 16. Namely, each reference voltage generator 11 to 14 has two voltage input points; i.e., one is connected to the forward wiring 15, the other is connected to the backward wiring 16. Also in FIG. 1, a voltage is supplied from a single voltage supply point 17 to the forward wiring 15 and the backward wiring 16, where the forward wiring 15 and the backward wiring 16 are concatenated intact, so that voltage input points of all reference voltage generators 11 to 14 are connected like a single stroke of the brush.

LCD driver LSIs in which these reference voltage generators (Vref generator) 11 to 14 are built, are arranged at a specified interval apart (for example, in X, Y directions) around liquid crystal cells (not shown), which actually display an image; and these LCD driver LSIs apply voltage to each source electrode or each gate electrode of these liquid crystal cells. A plurality of LCD driver LSIs provided in X and Y directions are generically called source drivers and gate drivers respectively, which pass video signals that are input via a video interface to an LCD controller (not shown) and responding to an output from the LCD controller, supply the voltage to the liquid crystal cells.

As is shown in FIG. 1, the first LCD driver LSI is connected to the voltage supply point 17 by a minimum wiring resistance (Rmin). On the other hand, in the forward wiring 15, the wiring resistance between adjacent LSIs gradually changes with the ratio of 1/(N−1), 1/(N−2), 1/(N−3), . . . , 1/1 in order, where N is the number of connected LSIs. In FIG. 1, there is shown wiring resistance R0/3, R0/2 and R0 based on a reference resistance R0, in both the forward wiring 15 and backward wiring 16. Hereby, the amount of voltage drop along the forward wiring 15 has a constant slope. Also, in the reference voltage generator 14, a connection between a voltage input point of the forward wiring 15 and a voltage input point of the backward wiring 16 is composed of an allowable minimum wiring resistance (Rmin). Likewise, in the backward wiring 16, the wiring resistance between adjacent LCD driver LSIs is gradually changed, using the same resistance values (i.e., wiring resistance R0/3, R0/2 and R0) as in the case of forward wiring 15. Hereby, the amount of voltage drop along the backward wiring 16 has also a constant slope, which is in the opposite direction to that of the forward wiring 15. Taking the time-average of these voltages by each reference voltage generator 11 to 14, approximately the same voltage can be generated in the individual LCD driver LSIs. However, the individual LCD driver LSIs is controlled to receive a voltage from the same side wiring at the same time.

Figure 2:
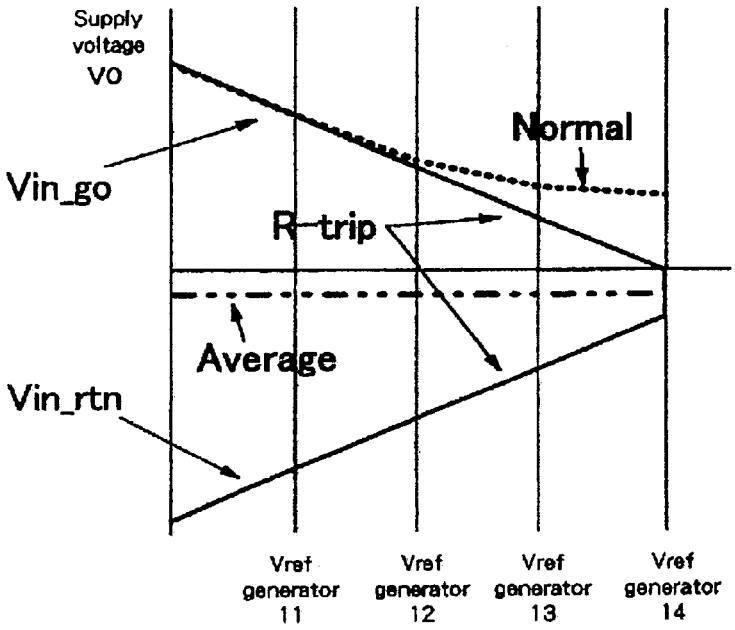
FIG. 2 depicts a diagram illustrating an operation concept in the case of supplying a voltage from a single point as is shown in FIG. 1.

FIG. 2 depicts a diagram illustrating an operation concept in the case of supplying a voltage from a single point as is shown in FIG. 1. In FIG. 2, a dashed line (Normal) shows the case of supplying a voltage using a wiring with a constant width, as in the past, a voltage drop is large on the side of the voltage supply point 17 where the current concentrates. A solid line (R-trip) shows the case of applying the present invention, where the amount of voltage drop is constant at each LCD driver LSI. Here the Vin_go indicates a voltage on the forward wiring 15, whereas Vin_rtn indicates a voltage on the backward wiring 16. A chain double-dashed line (Average) indicates a time-average between Vin_go and Vin_rtn. Here there is an offset voltage (V0—Average) in the obtained voltage, which shows a value lower than the voltage applied at voltage supply point 17, however, this can be coped with by setting the voltage to be supplied at the voltage supply point 17 higher by the offset voltage in advance.

In this way, according to the embodiment of the present invention, configured on the substrate is a forward wiring 15 and a backward wiring 16 whose wiring resistance gradually changes, wherein individual LCD driver LSIs receive a voltage from the forward wiring 15 and the backward wiring 16 alternately and generate a time-averaged voltage internally, thereby reducing the difference of voltages used in the individual LCD driver LSIs. Namely, by means of a wiring whose resistance gradually changes, an amount of voltage drop occurring in the individual LCD driver LSIs is kept constant, further by making the slopes of voltage drop of the forward and backward wirings in an opposite direction, the time-averaged voltage in each LCD driver LSI is kept about the same value.

Figure 3:
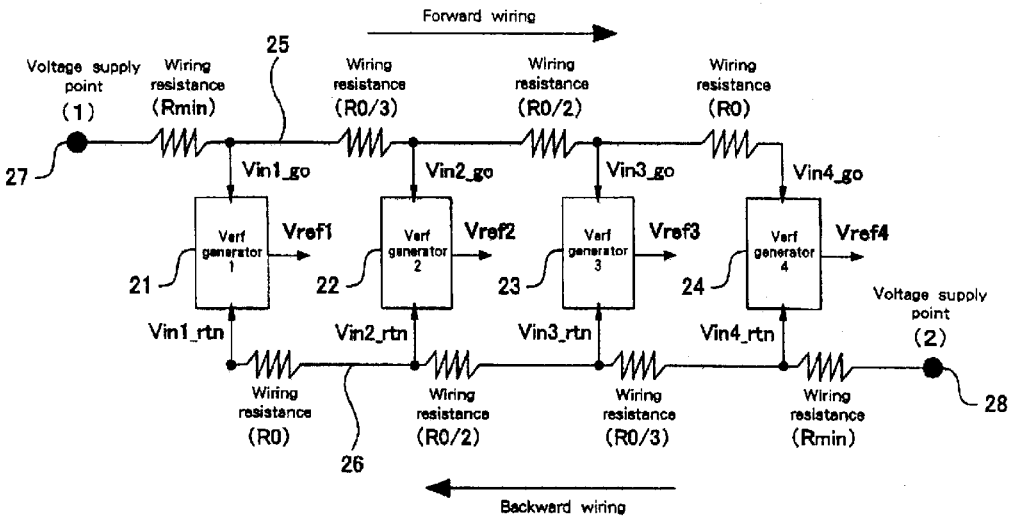
FIG. 3 depicts a diagram illustrating a fundamental configuration where a voltage supply point is provided in the backward wiring 26 as well.

FIG. 3 depicts a diagram illustrating a fundamental configuration where a voltage supply point is provided in the backward wiring as well. That is, in FIG. 3, as with FIG. 1, there are four LCD driver LSIs connected in a chain-like manner (i.e., one after another), reference voltage generators (Vref generator) 21 to 24 built in each LCD driver LSI are connected to the forward wiring 25 and backward wiring 26. Each reference voltage generator 21 to 24 has two voltage input points; i.e., one is connected to the forward wiring 25, the other is connected to the backward wiring 26; and a voltage supply point 27 is provided in the forward wiring 25 in the same way. However in FIG. 3, unlike the FIG. 1, the forward wiring 25 is detached from the backward wiring 26, and a voltage supply point 28 is also provided in the backward wiring 26. That is, an offset voltage is reduced by supplying a voltage to the backward wiring 26 as well.

Figure 4:
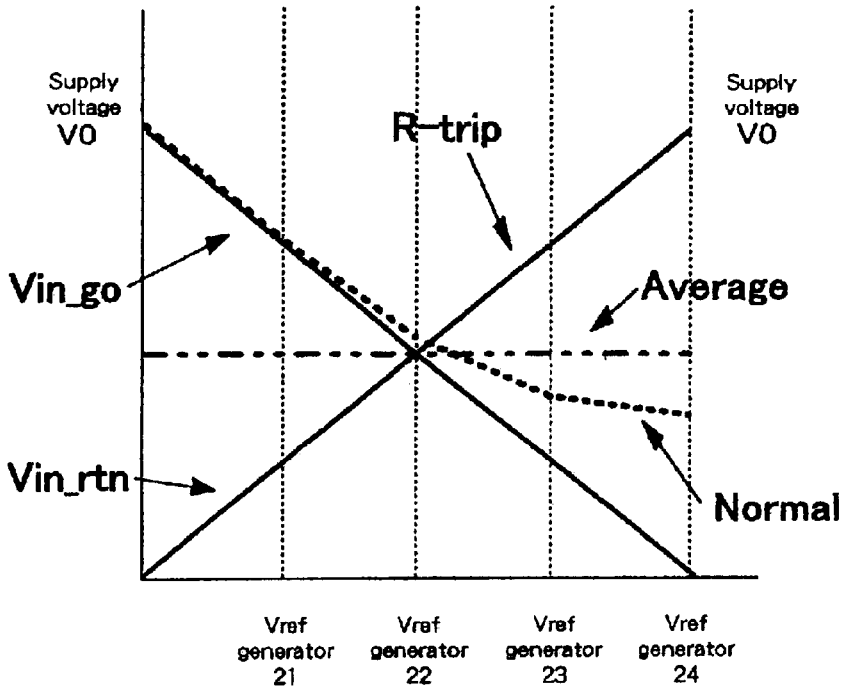
FIG. 4 depicts a diagram illustrating an operation concept in the case of supplying a voltage to the backward wiring 26 as well, as is shown in FIG. 3.

FIG. 4 depicts a diagram illustrating an operation concept in the case of supplying a voltage to the backward wiring 26 as well, as is shown in FIG. 3. Shown solid line (R-trip), dashed line (Normal), and chain double-dashed line (Average) mean the same things as in FIG. 2. A supply voltage V0 is supplied both to the forward wiring 25 and the backward wiring 26, whereby antithetical voltages (Vin_go and Vin_rtn) which keep a constant voltage drop between adjacent LCD driver LSIs, are supplied to each LCD driver LSI. By time-averaging these voltages at each reference voltage generator 21 to 24, the same voltage is generated in the individual LCD driver LSIs.

Figure 5:
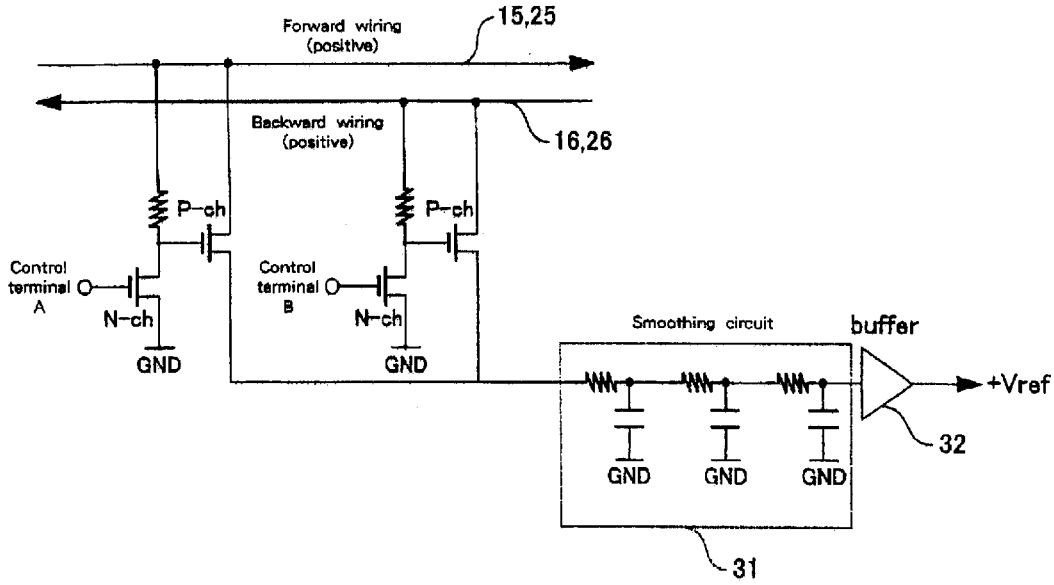
FIG. 5 depicts a configuration of a reference voltage generator.

FIG. 5 depicts a configuration of a reference voltage generator (11 to 14, 21 to 24). In the embodiment of the present invention, assuming the application to a liquid crystal display, a polarity inverts positive and negative, however, FIG. 5 shows a circuit that averages a positive polarity of voltage. A control terminal A and control terminal B are alternately controlled with 50% duty. Shown N-ch and P-ch are CMOS FET (Field Effect Transistor), which represent N channel and P channel respectively. Alternately input voltages are smoothed through a smoothing circuit 31. The averaged voltage is used inside the LCD driver LSIs via a buffer 32.

Figure 6:
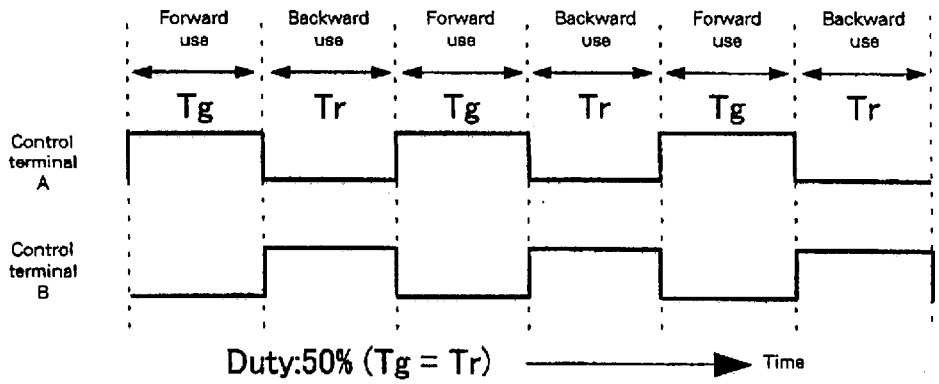
FIG. 6 depicts a controlled waveform of the reference voltage generator shown in FIG. 5.

In FIG. 6, shows control waveforms for the reference voltage generators (11 to 14, 21 to 24) shown in FIG. 5. As mentioned above, a control terminal A and control terminal B are alternately controlled with 50% duty. Tg shown represents a period of time to connect to the forward wiring 15, 25, whereas Tr represents a period of time to connect to the backward wiring 16, 26.

Note, not shown are the waveforms for a negative polarity. However, in the case of a negative polarity, P-ch FETs and N-ch FETs shown in FIG. 5 are replaced each other respectively. Regarding the control of the positive polarity shown in FIG. 5 and the negative polarity not shown in the reference voltage generators (11 to 14, 21 to 24), a voltage is supplied to all LCD driver LSIs, which are connected to the forward wiring 15, 25 and the backward wiring 16, 26, in synchronization from the same side wiring.

Figure 7:
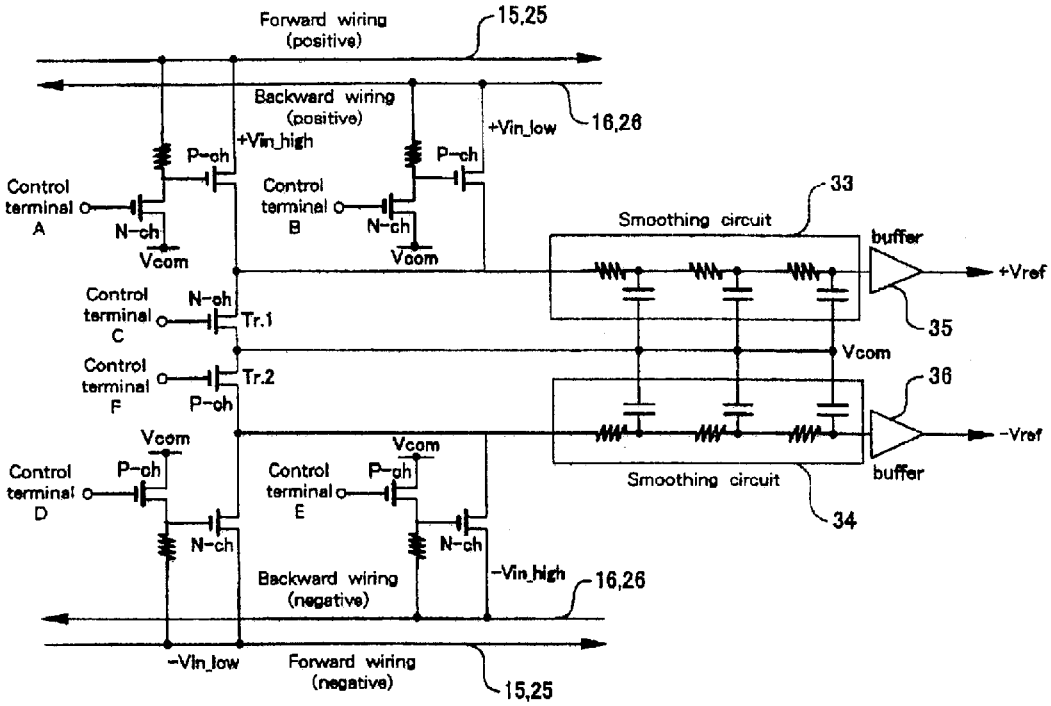
FIG. 7 depicts the configuration of the bipolar reference voltage generators.

FIG. 7 depicts a configuration of bipolar reference voltage generator (11 to 14, 21 to 24); i.e., the circuit that generates bipolar reference voltages for the LCD driver LSIs. FIG. 7 is configured by combining the positive polarity circuit shown in FIG. 5 and the aforementioned negative polarity circuit (not shown), wherein the center voltage is shown as Vcom. Also, in FIG. 7, two transistors (Tr. 1and Tr. 2) are added. By adjusting the period where the Tr. 1turns on, +Vref value of the generated voltage can be set within a rage of Vcom to +Vin_ave (which is generated using +Vin_high and +Vin_low as shown in FIG. 5 and FIG. 6), thereby generating a reference voltage for halftone. Also, by adjusting the period where the Tr. 2 turns on, −Verf value of the generated voltage can be set within a rage of Vcom to −Vin_ave (which is generated using −Vin_high and −Vin_low), thereby generating a reference voltage for halftone. Note that Vcom is not a back-and-forth wiring, it is based on the grounds that no voltage drop occurs in this wiring, because a current that flows into from the positive polarity circuit and a current that flows out to the negative polarity circuit are balanced. Also note that input voltages are smoothed via smoothing circuits 33, 34, and that the averaged voltages are used in the LCD driver LSI via buffers 35, 36.

Figure 8:
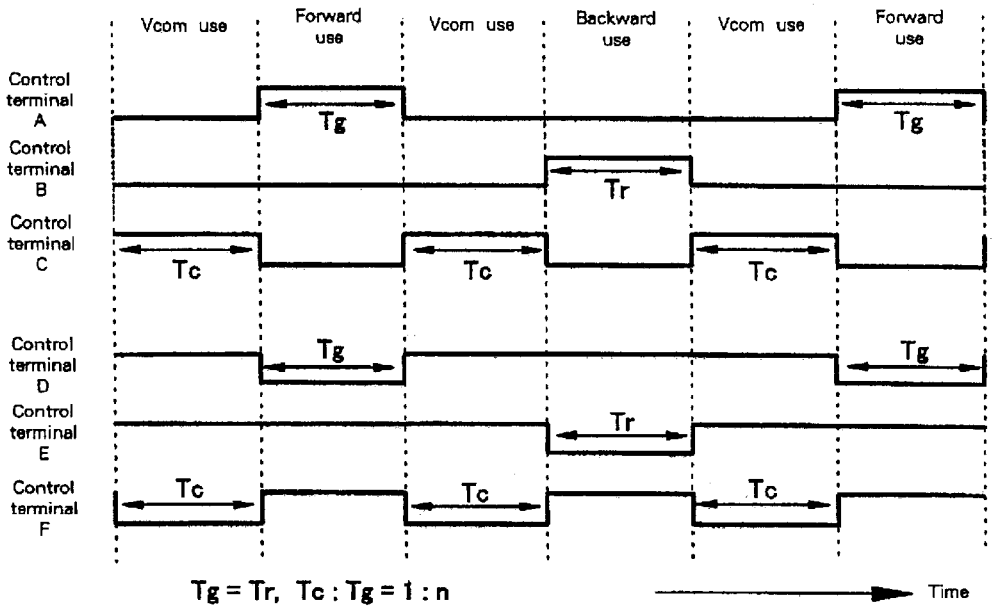
FIG. 8 depicts controlled waveforms for the reference voltage generators shown in FIG. 7.

FIG. 8 depicts a controlled waveform of the reference voltage generators (11 to 14, 21 to 24) shown in FIG. 7. In FIG. 8, Tg represents a period of time to connect to the forward wiring 15, 25, whereas Tr represents a period of time to connect to the backward wiring 16, 26. These Tg and Tr are controlled to be the same time length. In addition, Tc represents a period of time to connect to the intermediate voltage Vcom, wherein the reference voltage for halftone is adjusted by controlling the ratio n between Tg and Tc (the ratio between Tr and Tc).

Figure 9:
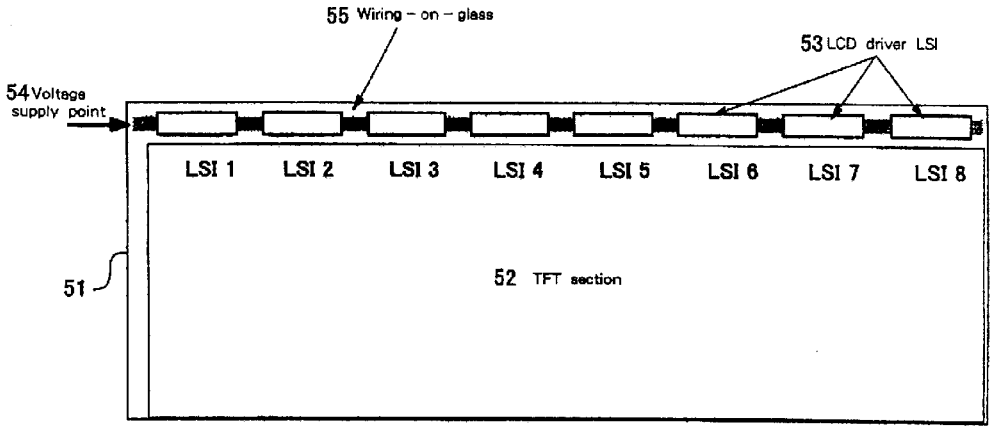
FIG. 9 depicts a wiring layout according to an embodiment of the present invention.

FIG. 9 depicts a wiring layout according an embodiment of the present invention. Provided on a glass substrate 51 is a TFT section 52 that consists of liquid crystal cells that actually displays an image. Furthermore, eight LCD driver LSIs 53 are arranged on the glass substrate 51. There is also provided on the glass substrate 51 a wiring-on-glass 55, which concatenates these eight LCD driver LSIs 53 in chain-like manner (i.e., one after another). This wiring-on-glass 55 consists of the aforementioned forward and backward wirings, wherein a voltage is input from a voltage supply point 54 and is supplied to the eight LCD driver LSIs 53 as an averaged voltage. The length of these LCD driver LSIs 53 is about 15 mm to 17 mm, and the wiring-on-glass 55 which concatenates these LCD driver LSIs 53 is about 6 mm to 25 mm between those LCD driver LSIs 53.

Figure 10:
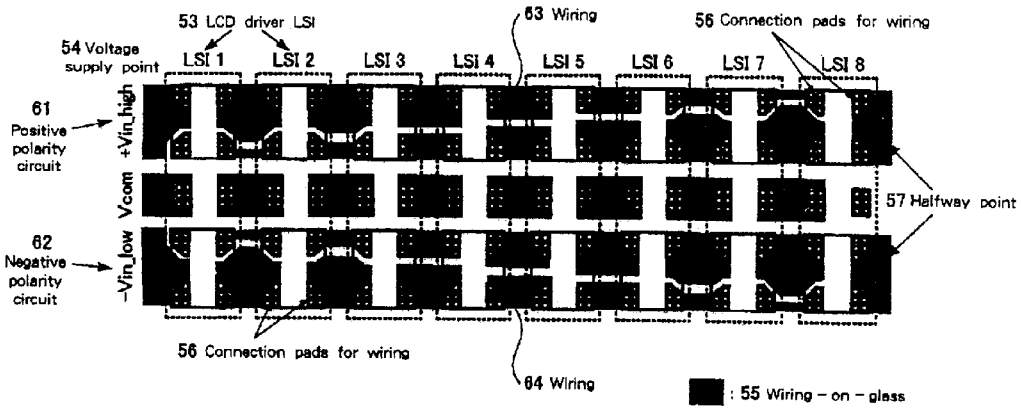
FIG. 10 depicts a wiring layout for a reference voltage when connecting eight LCD driver LSIs in a cascade connection like the wiring layout shown in FIG. 9.

FIG. 10 depicts a wiring layout for a reference voltage when connecting eight LCD driver LSIs 53 in a cascade connection like that shown in the wiring layout of FIG. 9. In the positive polarity circuit 61, individual LCD driver LSIs 53 are provided with a wiring 63 composed of a forward wiring and backward wiring. Likewise, in the negative polarity circuit 62, there is provided a wiring 64, which is composed of a forward wiring and backward wiring. Concerning these wirings 63 and 64, the forward wiring and the backward wiring are concatenated at a halfway point 57. Individual LCD driver LSIs 53 have two connection pads 56 for wiring in each of the forward wiring and backward wiring in the positive polarity circuit 61 and negative polarity circuit 62, respectively; thereby connecting to the forward wiring and backward wiring in the positive polarity circuit 61 and negative polarity circuit 62, respectively. These connection pads 56 for wiring are connected by means of metal wiring in the LCD driver LSIs 53, as a result, each LCD driver LSI 53 is connected in cascade connection by the wirings 63 and 64.

In this wiring layout shown in FIG. 10, the width of each wiring 63 and 64 is gradually reduced. In the forward wiring, the wiring width is widest at a portion entering the first LCD driver LSI 53 (LSI 1) from the voltage supply point 54, whereas the wiring width is smallest at a portion entering the eighth LCD driver LSI 53 (LSI 8) near the halfway point 57. On the other hand, in the backward wiring, the wiring width is widest at a portion entering the eighth LCD driver LSI 53 (LSI 8) from the halfway point 57, thereafter the width gradually decreases before entering each LCD driver LSI 53, and finally the width becomes smallest at a portion entering the first LCD driver LSI 53 (LSI 1). As a result, according to the wiring width of each wiring 63 and 64 which gradually changes, the wiring resistance gradually changes, resulting in the wiring structure such as a basic configuration drawing shown in FIG. 1. In other words, in order to obtain a wiring resistance shown in FIG. 1, a width of the wiring 63 shown in FIG. 10, which gradually changes is determined. By changing the wiring width in this way, voltage drop characteristics shown by the solid lines (R-trip) in FIG. 2 are obtained at each LCD driver LSI 53, thereby making the time-averaged voltages the same value. If it is impossible to thoroughly reduce the wiring resistance inside the LCD driver LSIs 53, countermeasures may be taken by calculating the wiring width on the glass substrate 51 in view of this wiring resistance.

Figure 11:
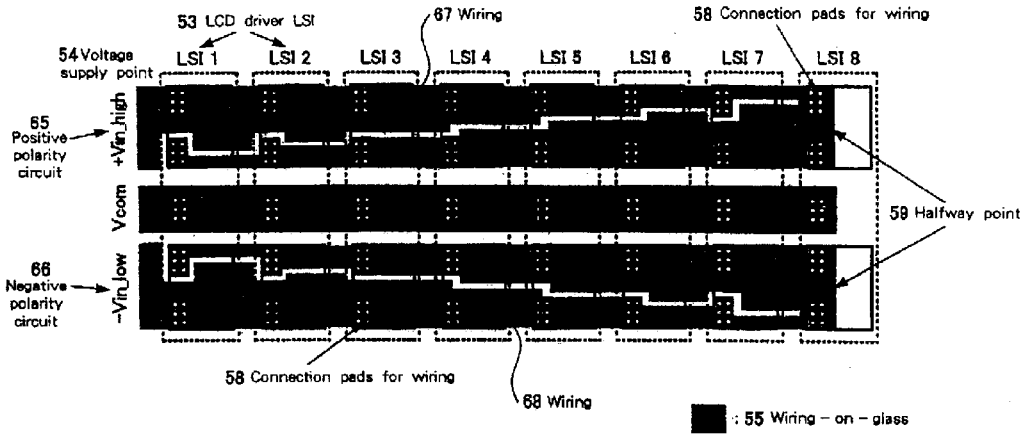
FIG. 11 depicts a wiring layout connecting the LCD driver LSIs 53 in a bus connection on a glass substrate.

FIG. 11 depicts a wiring layout when connecting the LCD driver LSIs 53 in bus connection on the glass substrate 51. Unlike FIG. 10, a voltage is supplied to each LCD driver LSI 53 one after another, without using a metal wiring inside the LCD driver LSIs 53. For each LCD driver LSI 53, there are provided connection pads 58 for wiring in each of the forward and backward wirings 67 in the positive polarity circuit 65, while in the negative polarity circuit 66, there are provided connection pads 58 for wiring in each of the forward and backward wirings 68. Concerning each wiring 67 and 68, the forward wiring and the backward wiring are concatenated at a halfway point 59. Furthermore, as with the wiring 63 and 64 shown in FIG. 10, the width of the wiring 67 and 68 is gradually reduced before entering each LCD driver LSI 53. The calculation method for this wiring width is the same as in the aforementioned FIG. 10. As with FIG. 10, in the layout structure of FIG. 11, a wiring structure such as a configuration drawing shown in FIG. 1 is obtained by gradually changing the wiring width, concatenating the forward and backward wirings, and supplying a voltage to LCD driver LSIs 53 from both of them. As a result, voltage drop characteristics shown in FIG. 2 are obtained.

Figure 12:
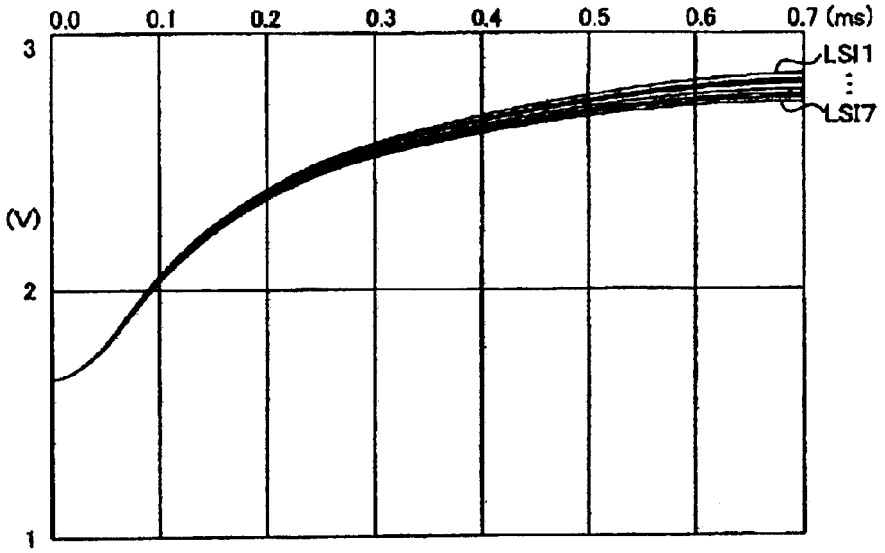
FIG. 12 (*a*) depicts the effects on the reference voltage generators according to the wiring of a conventional system.
Figure 12:
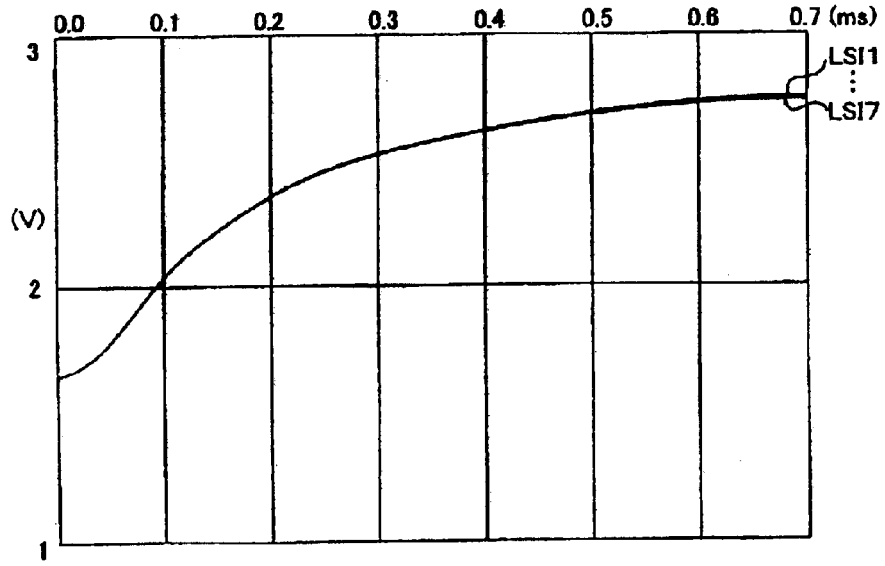

FIGS. 12(*a*) and (*b*) depict the effects of the embodiment of the present invention, wherein FIG. 12(*a*) shows the case of generating a reference voltage by means of a conventional system, wherein the LCD driver LSIs 53 are connected in cascade connection and the width of wiring between the LCD driver LSIs 53 is constant. Whereas FIG. 12(*b*) shows the case of generating a reference voltage with gradually changing the wiring width and connecting the LCD driver LSIs 53 in cascade connection. In both FIGS. 12(*a*) and (*b*), a sheet resistance of the wiring is 0.16Ω/μm, the chip length is 17 mm, the distance between the chips is 16 mm, and the number of chips is seven are used. As a reference voltage generation circuit, FIG. 12(*a*) used a circuit wherein the forward wiring 15, 25 and the backward wiring 16, 26 are short-circuited as is shown in FIG. 7, whereas FIG. 12(*b*) used a circuit shown in FIG. 7 intact. However, in each case, it is assumed that an LCD driver LSI 53 has five reference voltage generators for γ characteristic approximation. In both FIGS. 12(*a*) and (*b*), a horizontal axis represent time and a vertical axis represents voltage, and it is shown that the voltage becomes stable at about 700 μs (0.7 ms). Outputs of the graph correspond to LSI 1(chip 1), LSI 2 (chip 2), . . . , LSI 7 (chip 7), from above in order. As is evident from a comparison between FIG. 12(*a*) and FIG. 12(B), dispersion among chips becomes large at 0.7 ms when the voltage becomes stable.

FIGS. 13(*a*) and (*b*) shows values used in the simulation of FIGS. 12(*a*) and (*b*). FIG. 13(*a*) shows the wiring width and wiring resistance used in this simulation, i.e., according to the system of the present invention, the resistance changes between LSIs (LCD driver LSIs). FIG. 13(*b*) shows a voltage at 700 μs (0.7 ms) after starting a circuit operation, as a voltage difference (mV) among the chips in each system. FIG. 13(*b*) also shows a worst value in consideration of +/−10% change of the wiring thickness and +/−1 μm change of the wiring width, because of the change of wiring process.

As is appreciated from FIGS. 12(*a*), (*b*) and FIGS. 13(*a*), (*b*), using the wiring conformation according to the present invention, the dispersion of voltages among the chips generated in each LCD driver LSI 53 can be reduced to about one-ninth to one-tenth. Also, even in the case where the wiring process changes within the aforementioned range, dispersion of voltages can be reduced to about one-seventh to one-eighth. In the above case, the width of forward and backward wirings for positive and negative outputs is 187 μm, and the wiring width for Vcom is 107 μm. Assuming that the interval between the wirings is 20 μm total width becomes 561 s μm FIG. 13(*b*) also shows a voltage difference generated when using this width to implement a conventional ladder resistor system. Comparing this ladder resistor system with the system of the present invention, it proves that the voltage difference is reduced to about two-thirds around the middle voltage. On the other hand, the voltage difference is reduced to about one-ninth around the high voltage, thereby proving that the present system is superior to the ladder resistor system. That is, when using the forward wiring and the backward wiring alternately with 50% duty, there occurs a voltage difference no less than 100 mV in the conventional system, whereas it is reduced to about 10 mV in the present system. For example, assuming 64 gradations as a whole, one gradation corresponds to 20 mV, so 100 mV of deviation in the conventional system gets to no less than five gradations. These five gradations in 64 gradations can be perceived as a difference by human eyes, so an image quality can be significantly improved by employing the present invention.

The embodiments of the present invention have been described about the wiring structure applied to the drivers of the LCD modules, the present invention is not limited to this embodiment, but applicable to wiring structures in other equipment. In particular, it is widely applied in the case where a plurality of LSIs are concatenated in a chain-like manner (one after another), wherein a nearly uniform voltage should be supplied to them.

As described above, according to the present invention, it is possible to keep the voltage that is received in the individual LSIs about the same value, thereby alleviating a significant deterioration of an image quality, for example.

Note that considering the present invention as a computer, the present invention further includes a host for executing an application, and a plurality of driver LSIs mounted on the substrate for applying voltages to the liquid crystal cells based on a signal from the host.

As note that these wiring structures are not necessarily limited to use in a liquid crystal display, but applicable to a case where a plurality of LSIs are connected in a chain-like manner (i.e., one after another) such as cascade or bus-like manner.

It is to be understood that the provided illustrative examples are by no means exhaustive of the many possible uses for my invention.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims:

What is claimed is:

1. An LCD module, comprising:

liquid crystal cells forming an image display area on a substrate;

a plurality of driver LSIs mounted on said substrate for applying voltages to said liquid crystal cells; and a wiring structure formed on said substrate for supplying a voltage to said plurality of driver LSIs, wherein said wiring structure supplies the voltage to said plurality of driver LSIs, with the wiring resistance gradually changing from a voltage supply point, and said wiring resistance between adjacent LSIs gradually changes with the ratio of approximately 1/(N−1), 1/(N−2), 1/(N−3), . . . , 1/1 in order (where N is the number of connected LSIs), and wherein said wiring structure supplies the voltage to said plurality of driver LSIs via a forward wiring and a backward wiring.

2. The LCD module according to claim 1, wherein said forward wiring and said backward wiring are connected like a single stroke of the brush to supply the voltage to said plurality of driver LSIs.

3. An LCD module, comprising:

liquid crystal cells forming an image display area on a substrate;

a plurality of driver LSIs mounted on said substrate for applying voltages to said liquid crystal cells; and a wiring structure formed on said substrate for supplying a voltage supplied from a voltage supply point to said plurality of driver LSIs;

wherein said wiring structure comprising:

a forward wiring that starts wiring of said driver LSIs tram a driver LSI located near said voltage supply point up to a downstream driver LSI in order, thereby supplying the voltage to said plurality of driver LSIs; and a backward wiring that starts wiring of said driver LSIs from said downstream driver LSI up to the driver LSI located near said voltage supply point in order, thereby supplying the voltage to said plurality of driver LSIs; wherein the directions of voltage drop in said forward wiring and said backward wiring are opposite, and wiring resistance used for said forward wiring and said backward wiring gradually change such that said wiring resistance between adjacent LSIs gradually changes with the ratio of approximately 1/(N−1), 1/(N−2), 1/(N−3), . . . , 1/1 in order (where N is the number of connected LSIs).

4. The LCD module according to claim 3, wherein said wiring structure is characterized in that, in said forward wiring, a wiring width is gradually reduced from the wiring for the driver LSI located near said voltage supply point to the wiring for said downstream driver LSI, whereas in said backward wiring, a wiring width is gradually reduced from the wiring for said downstream driver LSI to the wiring for the driver LSI located near said voltage supply point.

5. The LCD module according to claim 3, wherein said plurality of driver LSIs includes input pads and output pads for connection corresponding respectively to said forward wiring and said backward wiring of said wiring structure, wherein said input pads and said output pads are connected by the wiring inside said plurality of driver LSIs.

6. The LCD module according to claim 3, wherein said plurality of driver LSIs are bus-connected to said forward wiring and said backward wiring of said wiring structure.

7. A wiring structure which supplies a voltage to a plurality of LSIs arranged at a specified interval apart, comprising:

a voltage supply point receiving a voltage; and a wiring section that starts wiring of said LSIs from a LSI located near said voltage supply point up to a downstream LSI in order, thereby supplying the voltage to said plurality of LSIs;

wherein the wiring width is gradually reduced toward said downstream side, and wiring resistance between adjacent LSIs gradually changes with the ratio of approximately 1/(N−1), 1/(N−2), 1/(N−3), . . . , 1/1 in order (where N is the number of connected LSIs).

8. A wiring structure which supplies a voltage to a plurality of LSIs arranged at a specified interval apart, comprising:

a forward wiring and a backward wiring on a substrate on which said plurality of LSIs are arranged, wherein a wiring resistance of said wirings gradually changes for said forward wiring and said backward wiring, and said wiring resistance between adjacent LSIs gradually changes with the ratio of approximately 1/(N−1), 1/(N−2), 1/(N−3), . . . , 1/1 in order (where N is the number of connected LSIs); and wherein the voltage is supplied to said plurality of LSIs from both said forward wiring and said backward wiring.

9. The wiring structure according to claim 8, wherein said forward wiring and said backward wiring are detached from each other, and said forward wiring and said backward wiring are supplied a voltage from different voltage supply points.

10. The wiring structure according to claim 8, wherein said forward wiring and said backward wiring are concatenated, and said forward wiring and said backward wiring are supplied a voltage from the same voltage supply point.

11. A method for supplying a voltage to a plurality of LSIs mounted on a substrate, the method comprising the steps of:

wiring said plurality of LSIs on said substrate using a forward wiring and a backward wiring whose wiring resistance gradually changes;

supplying said plurality of LSIs with a voltage from both said forward wiring and said backward wiring;

causing said plurality of LSIs to time-average the received voltage to generate a reference voltage; and causing a wiring resistance used for said forward wiring and said backward wiring to gradually change, wherein said wiring resistance between adjacent LSIs gradually changes with the ratio of approximately 1/(N−1), 1/(N−2), 1/(N−3), . . . , 1/1 in order (where N is the number of connected LSIs).

12. A method for supplying a voltage to a plurality of driver LSIs mounted on a substrate, the method comprising the steps of:

providing a, wiring of high resistivity, which gradually changes the wiring width on said substrate, said wiring has a resistance between adjacent LSIs that gradually changes with the ratio of approximately 1/(N−1), 1/(N−2), 1/(N−3), . . . , 1/1 in order (where N is the number of connected LSIs);

connecting said plurality of driver LSIs to said wiring of high resistivity in order;

supplying a voltage to said wiring of high resistivity;

supplying a voltage to said driver LSIs via said wiring of high resistivity, wherein a voltage drop occurs between the individual driver LSIs; and generating a reference voltage for γ compensation in said driver LSIs based on the supplied voltage.

13. A computer, comprising:

a host executing applications;

liquid crystal cells forming an image display area on a substrate;

a plurality of driver LSIs mounted on said substrate for applying voltages to said liquid crystal cells based on signals from said host; and a wiring structure formed on said substrate for supplying a voltage supplied from a voltage supply point to said plurality of driver LSIs, wherein said wiring structure comprising:

a forward wiring that starts wiring of said driver LSIs from a driver LSI located near said voltage supply point up to a downstream driver LSI in order, thereby supplying the voltage to said plurality of driver LSIs; and a backward wiring that starts wiring of said driver LSIs from said downstream driver LSI up to the driver LSI located near said voltage supply point in order, thereby supplying the voltage to said plurality of driver LSIs; wherein the directions of voltage drop in said forward wiring and said backward wiring are opposite and a wiring resistance used for said forward wiring and said backward wiring gradually change such that said wiring resistance between adjacent LSIs gradually changes with the ratio of approximately 1/(N−1), 1/(N−2), 1/(N−3), . . . , 1/1 in order (where N is the number of connected LSIs).

* * * * *